US008341806B2

(12) United States Patent
Parker et al.

(10) Patent No.: US 8,341,806 B2
(45) Date of Patent: Jan. 1, 2013

(54) STEP STOOL, HINGE AND METHOD

(75) Inventors: Thomas W. Parker, Jamestown, PA (US); John J. Fiumefreddo, New Wilmington, PA (US)

(73) Assignee: Werner Co., Greenville, PA (US)

( * ) Notice: Subject to any disclaimer, the term of this patent is extended or adjusted under 35 U.S.C. 154(b) by 0 days.

(21) Appl. No.: 11/985,988

(22) Filed: Nov. 19, 2007

(65) Prior Publication Data

US 2008/0066261 A1 Mar. 20, 2008

Related U.S. Application Data

(62) Division of application No. 11/264,105, filed on Nov. 1, 2005, now Pat. No. 7,311,177, which is a division of application No. 10/846,811, filed on May 14, 2004, now Pat. No. 7,100,739.

(51) Int. Cl.
*E05D 11/10* (2006.01)

(52) U.S. Cl. ..... 16/326; 16/349; 16/353

(58) Field of Classification Search ..... 16/326, 16/348, 349, 352, 353, 321, 324, 327, 328, 16/331, 332, 365; 182/165, 152, 156, 163, 182/23, 180.1

See application file for complete search history.

(56) References Cited

U.S. PATENT DOCUMENTS 3,352,580 A * 11/1967 Kurz et al. ..... 16/365
3,768,592 A * 10/1973 Higgins ..... 182/22
3,811,151 A * 5/1974 Kuemmerlin ..... 16/329
3,918,822 A * 11/1975 Rauschenberger ..... 16/365
4,407,045 A * 10/1983 Boothe ..... 16/327
4,483,415 A * 11/1984 Disston et al. ..... 182/22
4,566,150 A * 1/1986 Boothe ..... 16/332
4,666,327 A * 5/1987 Su ..... 403/24
4,684,278 A * 8/1987 Rauschenberger ..... 16/365
4,890,950 A * 1/1990 Yoo ..... 403/96
5,353,892 A * 10/1994 Lu ..... 182/163
6,343,406 B1 * 2/2002 Yeh ..... 16/328
6,443,261 B1 * 9/2002 Gibson et al. ..... 182/161
6,711,780 B2 * 3/2004 Lee ..... 16/326
2004/0216277 A1 * 11/2004 Beaver ..... 16/324
2006/0102425 A1 * 5/2006 Moldthan et al. ..... 182/129

* cited by examiner

*Primary Examiner* — Jeffrey O Brien
(74) *Attorney, Agent, or Firm* — Ansel M. Schwartz

(57) ABSTRACT

A folding step stool includes a hinge mechanism. The step stool includes a first section connected to the hinge mechanism. The first section having a bottom step. The step stool includes a second section connected to the hinge mechanism. The step stool includes a third section connected to the hinge mechanism, wherein when the folding step is in and unfolded state, the first and second sections form a base on a floor and are in angular relationship with each other, and the third section extends upward from the hinge mechanism relative to the first section, and when the first, second and third sections are in a folded state, they are essentially in parallel with each other, are no more than ¾ as tall and ½ as long as when the step stool is in the unfolded state. A method for using a folding step stool. A hinge for a folding step stool having a folded and unfolded state and having a top rail, front rail and rear rail. A method for using a folding step stool.

8 Claims, 18 Drawing Sheets

STEP STOOL, HINGE AND METHOD

This application is a divisional of application Ser. No. 11/264,105 filed on Nov. 1, 2005, now U.S. Pat. No. 7,311,177 which is a divisional of application Ser. No. 10/846,811 filed on May 14, 2004, now U.S. Pat. No. 7,100,739 issued Sep. 5, 2006.

FIELD OF THE INVENTION

The present invention is related to a folding step stool. More specifically, the present invention is related to a folding step stool that is no more than ¾ as tall and ½ as long in a folded state as when the step stool is in the unfolded state.

BACKGROUND OF THE INVENTION

Step stools are very useful in the home for enabling the user to reach areas that would otherwise be unreachable, whether the intent is to access storage cabinets, do cleaning, change light bulbs, etc. Commonly step stools are designed to fold so that the front to rear dimension is greatly reduced. This permits the stepstool to be stored more easily. However, this folding does not reduce the height of the stepstool. Thus, a tall or long storage area is required even though the step stool may have assumed a much flatter configuration.

The purpose of this invention is to provide a useful 3 step stepstool that, when folded, is substantially smaller in both the front to rear dimension and also in height. When folded, this stepstool is compact enough to permit storage in the cabinet under the average kitchen sink. It could also be stored easily on the floor of a clothes closet without the inconvenience of having to push aside hanging garments. In short, this design will permit the stepstool to be stored more easily and more conveniently.

BRIEF SUMMARY OF THE INVENTION

The present invention pertains to a folding step stool. The step stool comprises a hinge mechanism. The step stool comprises a first section connected to the hinge mechanism. The first section having a bottom step. The step stool comprises a second section connected to the hinge mechanism. The step stool comprises a third section connected to the hinge mechanism, wherein when the folding step is in and unfolded state, the first and second sections form a base on a floor and are in angular relationship with each other, and the third section extends upward from the hinge mechanism relative to the first section, and when the first, second and third sections are in a folded state, they are essentially in parallel with each other, are no more than ¾ as tall and ½ as long as when the step stool is in the unfolded state.

The present invention pertains to a method for using a folding step stool. The method comprises the steps of gripping a third section of the folding step stool that is in an unfolded state. There is the step of moving the folding step stool into a folded state by moving the third section toward a second section of the step stool about a hinge mechanism connected to the third section, second section and a first section of the step stool until the first, second and third sections are essentially in parallel with each other, are no more than ¾ as tall and ½ as long as when the step stool is in the unfolded state.

The present invention pertains to a hinge for a folding step stool having a folded and unfolded state and having a top rail, front rail and rear rail. The hinge comprises an upper portion that holds the top rail. The hinge comprises a lower portion that holds the front rail and rear rail. The hinge comprises a bushing that extends through the upper and lower portions and rear rail and holds the upper and lower portions and rear rail together and about which the upper and lower portions and rear rail rotate relative to each other.

The present invention pertains to a method for using a folding step stool. The method comprises the steps of pushing on both knobs of hinges of the step stool to unlock the hinges. There is the step of unfolding the step stool until bars of the hinges snap outward. There is the step of snapping the bars into a locked state to place the hinges into a locked state.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
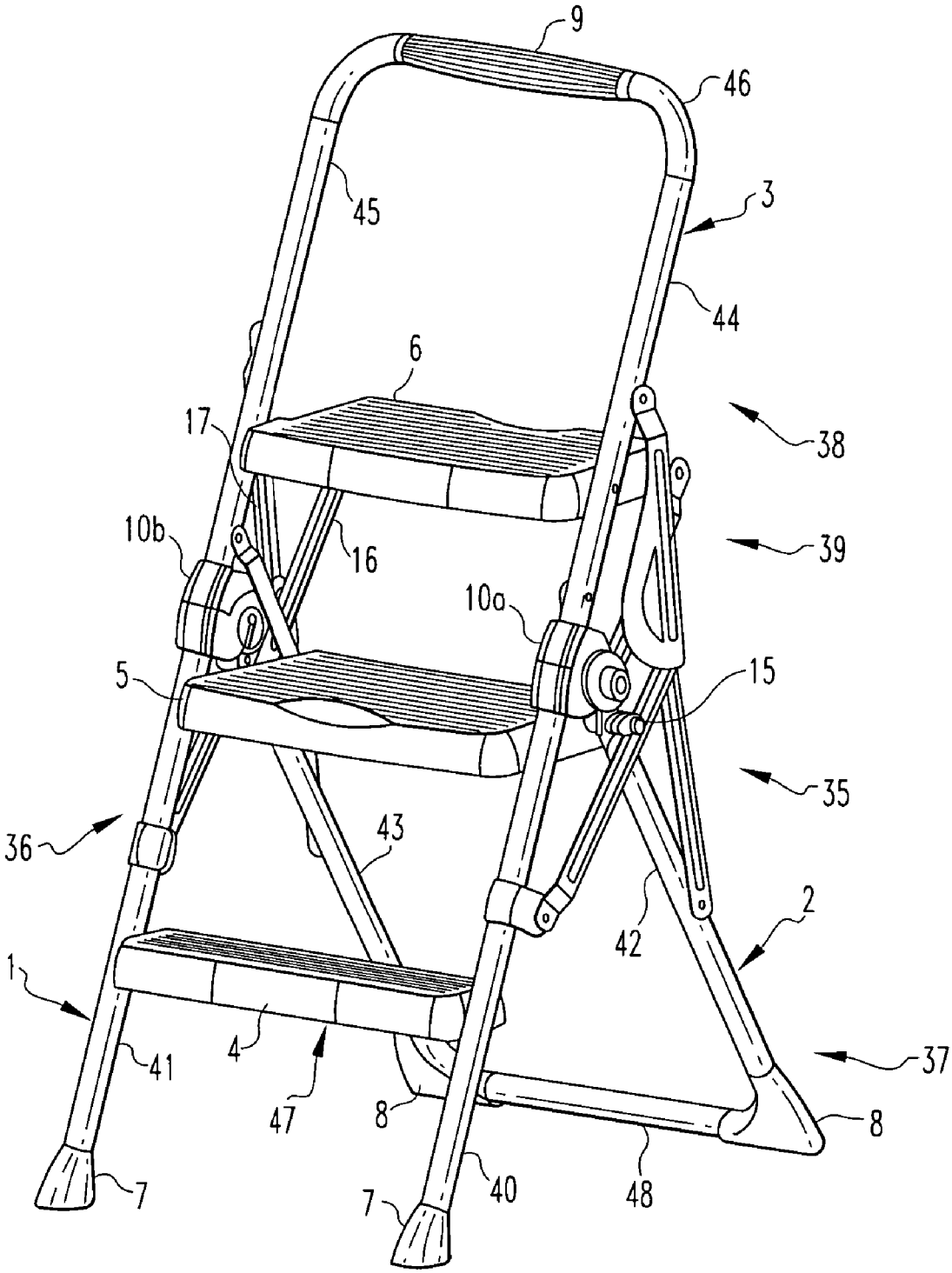
FIG. 1 is a perspective view of an unfolded folding step stool of the present invention.

Referring now to the drawings wherein like reference numerals refer to similar or identical parts throughout the several views, and more specifically to FIG. 1 thereof, there is shown a folding step stool 100. The step stool 100 comprises a hinge mechanism 35. The step stool 100 comprises a first section 36 connected to the hinge mechanism 35. The first section 36 has a bottom step. The step stool 100 comprises a second section 37 connected to the hinge mechanism 35. The step stool 100 comprises a third section 38 connected to the hinge mechanism 35, wherein when the folding step stool 100 is in and unfolded state, the first and second sections form a base on a floor and are in angular relationship with each other, and the third section 38 extends upward from the hinge mechanism 35 relative to the first section 36, and when the first, second and third sections are in a folded state, they are essentially in parallel with each other, are no more than ¾ as tall and ½ as long as when the step stool 100 is in the unfolded state. Preferably, they are no more than ⅗ as tall and ¼ as long.

Preferably, the step stool 100 includes a support mechanism 39 for supporting the step stool 100 when it is in an unfolded state. The hinge mechanism 35 preferably includes a first hinge and a second hinge 10. The first section 36 includes a first side rail 40 connected with the first hinge 10*a* and a second side rail 41 connected with the second hinge 10*b*. The second section 37 includes a third side rail 42 connected to the first hinge 10*a* and a fourth side rail 43 connected to the second hinge 10*b*. The third section 38 includes a fifth side rail 44 connected to the first hinge 10*a* and a sixth side rail 45 connected to the second hinge 10*b* and a top bar 46 extending between the fifth and sixth side rails.

Preferably, the supporting mechanism 39 includes a top link 11 connected to the fifth rail 44, a rear link 12 connected to the top link 11 and the third rail 42, and a front link 13 connected to the top and rear links. The bottom step 4 is preferably connected to the first and second rails; and the step stool 100 preferably includes a middle step 5 connected to the first, second, third and fourth rails; and a top step 6 connected to the fifth and sixth rails. Preferably, the support mechanism 39 includes a top step link 16 connected to the top step 6 and the third rail 42. The support mechanism 39 preferably includes a link bracket 14 connected to the first rail 40 and the front link 13.

Preferably, the support mechanism 39 includes a link brace 15 connected to the third rail 42 against which the front link 13 bears against when the folding step stool 100 is in the unfolded state. The top link 11 preferably has a semi-circular extension 25 which prevents objects from being caught between the top link 11 and the front link 13 as the folding step stool 100 moves from the unfolded state to the folded state. Preferably, the step stool 100 includes a middle step link 17 connected to the middle step 5 and the fifth rail 44.

The top bar 46 preferably has a hand grip. Preferably, where the top link, bottom link and rear link connect with each other defines a pivot 19. The first section 36 preferably includes a front cross piece 47 connected to the first and second rails and the bottom step 4, and together define a front rail 1. Preferably, the second section 37 includes a rear cross piece 48 connected to the third and fourth rails and are one continuous u-shaped piece which define a rear rail 2. The fifth and sixth rails and the top bar 46 are preferably one continuous u-shaped piece and define a top rail 3.

The present invention pertains to a method for using a folding step stool 100. The method comprises the steps of gripping a third section 38 of the folding step stool 100 that is in an unfolded state. There is the step of moving the folding step stool 100 into a folded state by moving the third section 38 toward a second section 37 of the step stool 100 about a hinge mechanism 35 connected to the third section 38, second section 37 and a first section 36 of the step stool 100 until the first, second and third sections are essentially in parallel with each other, are no more than ¾ as tall and ½ as long as when the step stool 100 is in the unfolded state. Preferably, they are no more than ⅗ as tall and ¼ as long.

Figure 12:
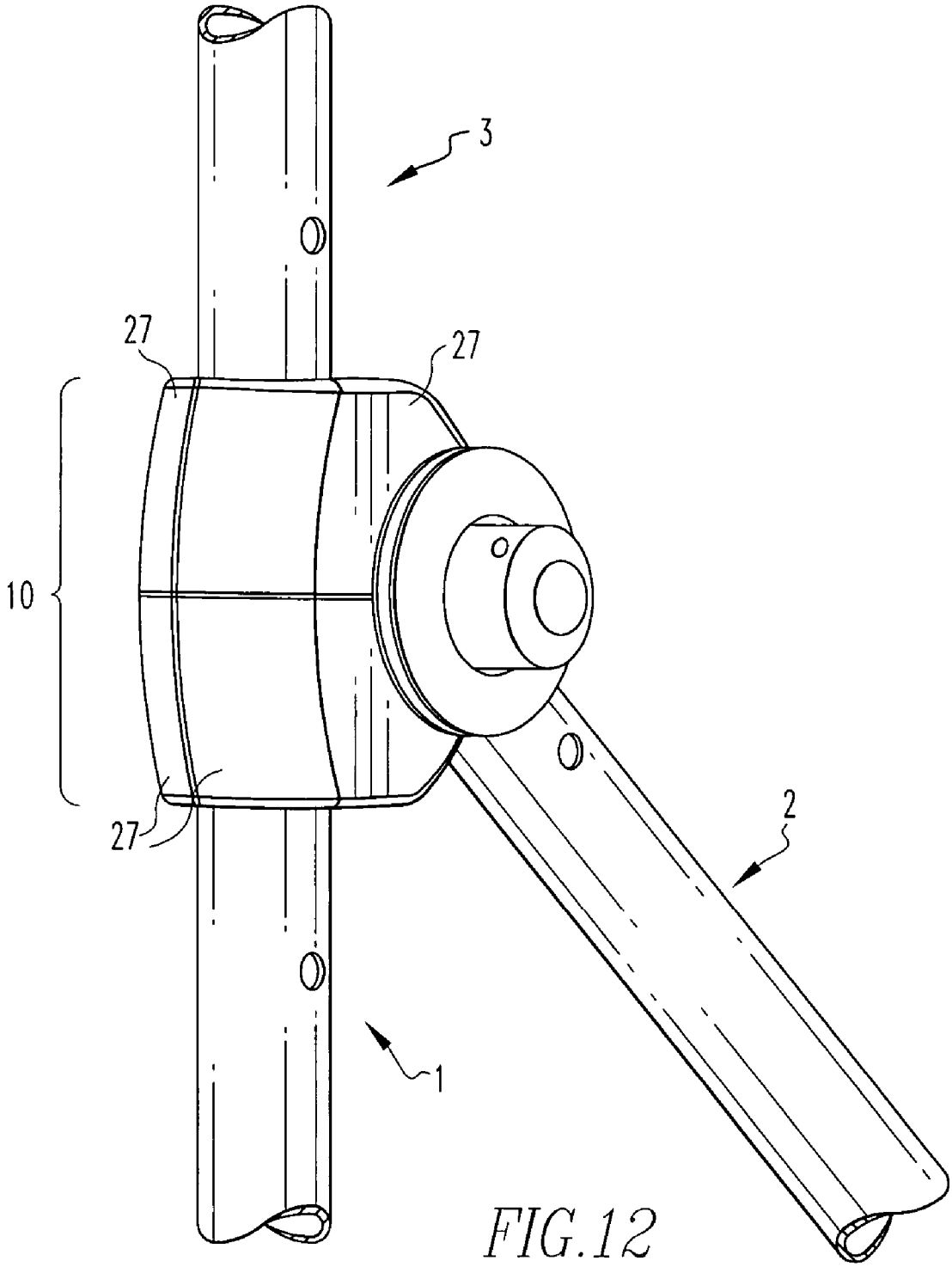
FIG. 12 shows a hinge of the present invention.
Figure 15:
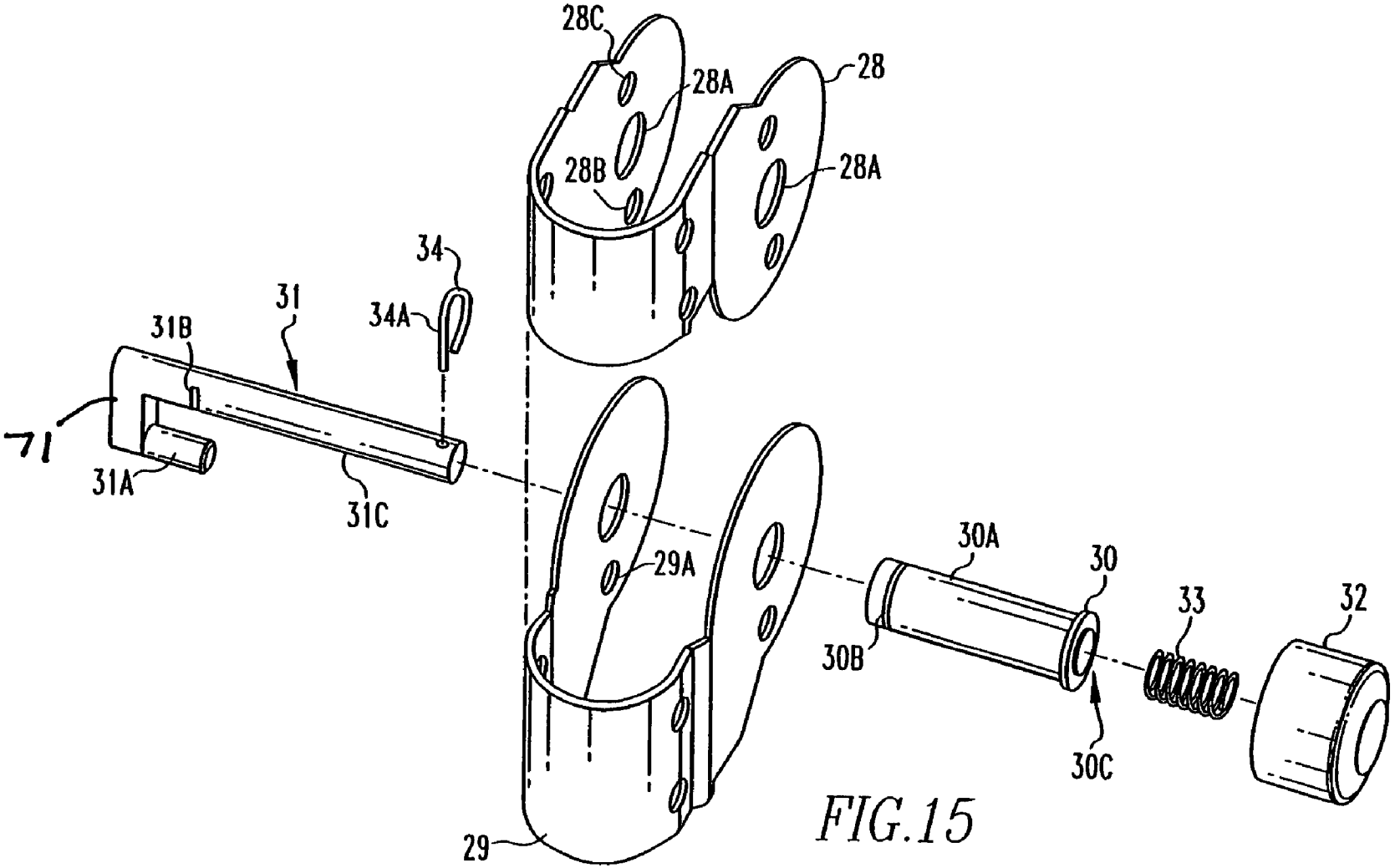
FIG. 15 is an exploded view of the hinge.

The present invention pertains to a hinge 10 for a folding step stool 100 having a folded and unfolded state and having a top rail 3, front rail 1 and rear rail 2, as shown in FIGS. 12 and 15. The hinge 10 comprises an upper hinge 28 that holds the top rail 3. The hinge 10 comprises a lower hinge 29 that holds the front rail 1 and rear rail 2. The hinge 10 comprises a bushing 30 that extends through the upper and lower hinges and rear rail 2 and holds the upper and lower hinges and rear rail 2 together and about which the upper and lower hinges and rear rail 2 rotate relative to each other.

Figure 14:
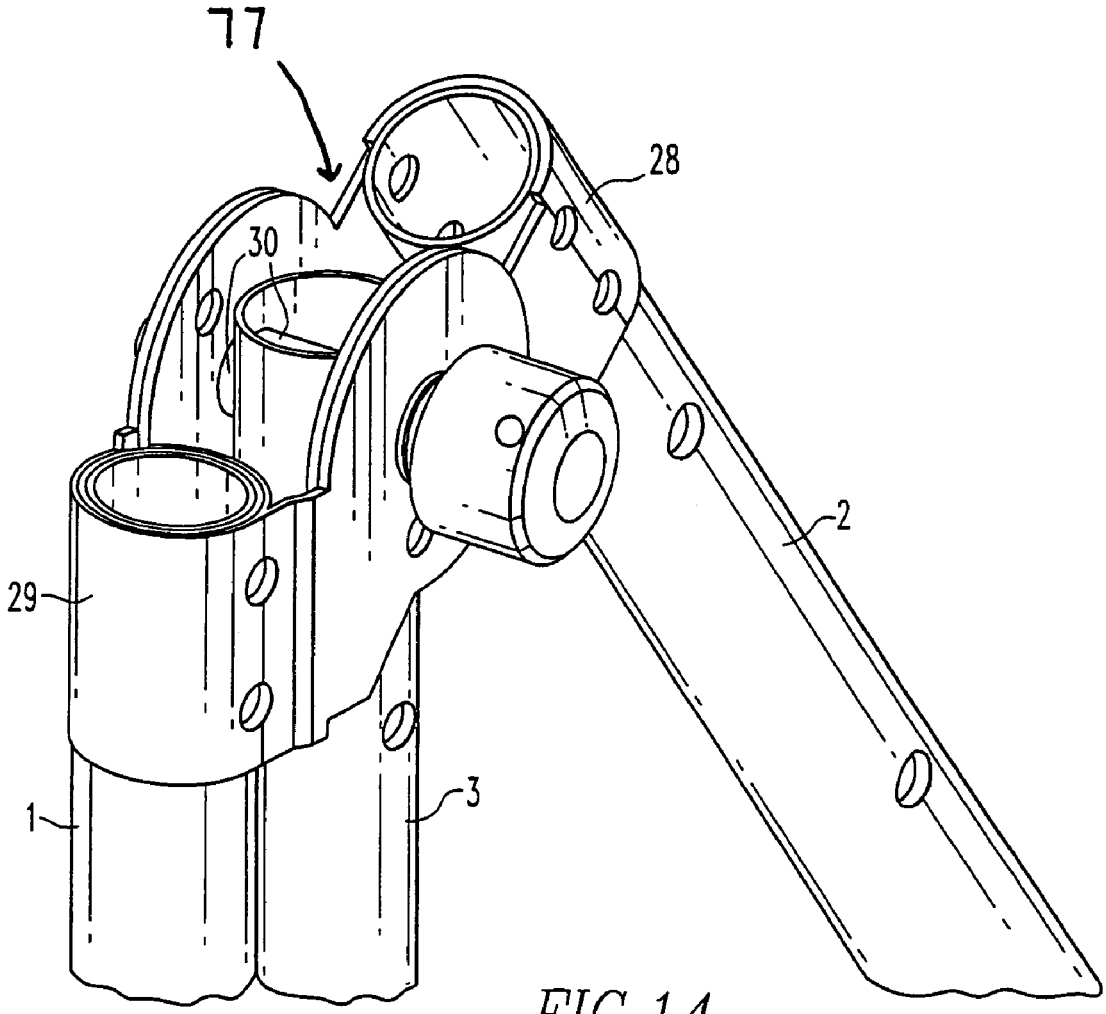
FIG. 14 shows the hinge in an intermediate state between the folded and unfolded state.

Preferably, the hinge 10 includes a bar 31 that has a shank 31*c* and a projection 31*a*, and the bushing 30 has a center hole 30*c* in which the shank 31*c* is disposed and rotates freely, and the projection 31*a* fits into the lower hinge 29 which constrains the bar 31 to move with the lower hinge 29 in the folded or unfolded state, and the projection 31*a* fits into the upper hinge 28 and either engages or disengages the upper hinge 28 when the bar 31 is slid axially in the bushing 30. The bushing 30 preferably has a flat 30*a* and the upper hinge 28 has a D shaped hole 28*a* which aligns with the flat 30*a* which constrains the bushing 30 to rotate with the upper hinge 28. The upper hinge 28 and the lower hinge 29 together form an envelope 77, as shown in FIG. 14, in which the top rail 3 and the front rail 1 and the rear rail 2 are disposed.

Preferably, the hinge 10 includes a knob 32 attached to the bar 31, and a spring 33 which is compressed between the knob 32 and the bushing 30. The bushing 30 preferably includes a bushing slot 30*b* and the hinge 10 includes a clip 34 which wraps about the bushing 30 and rests in the bushing slot 30*b* which serves to retain the bushing 30 in place and to hold the bar 31 in an unlatched position. Preferably, the spring 33 exerts a force on the bar 31 to keep the bar 31 in a locked position.

The present invention pertains to a method for using a folding step stool 100. The method comprises the steps of pushing on both knobs 32 of hinges 10 of the step stool 100 to unlock the hinges 10. There is the step of unfolding the step stool 100 until bars 31 of the hinges 10 snap outward. There is the step of snapping the bars 31 into a locked state to place the hinges 10 into a locked state.

Figure 2:
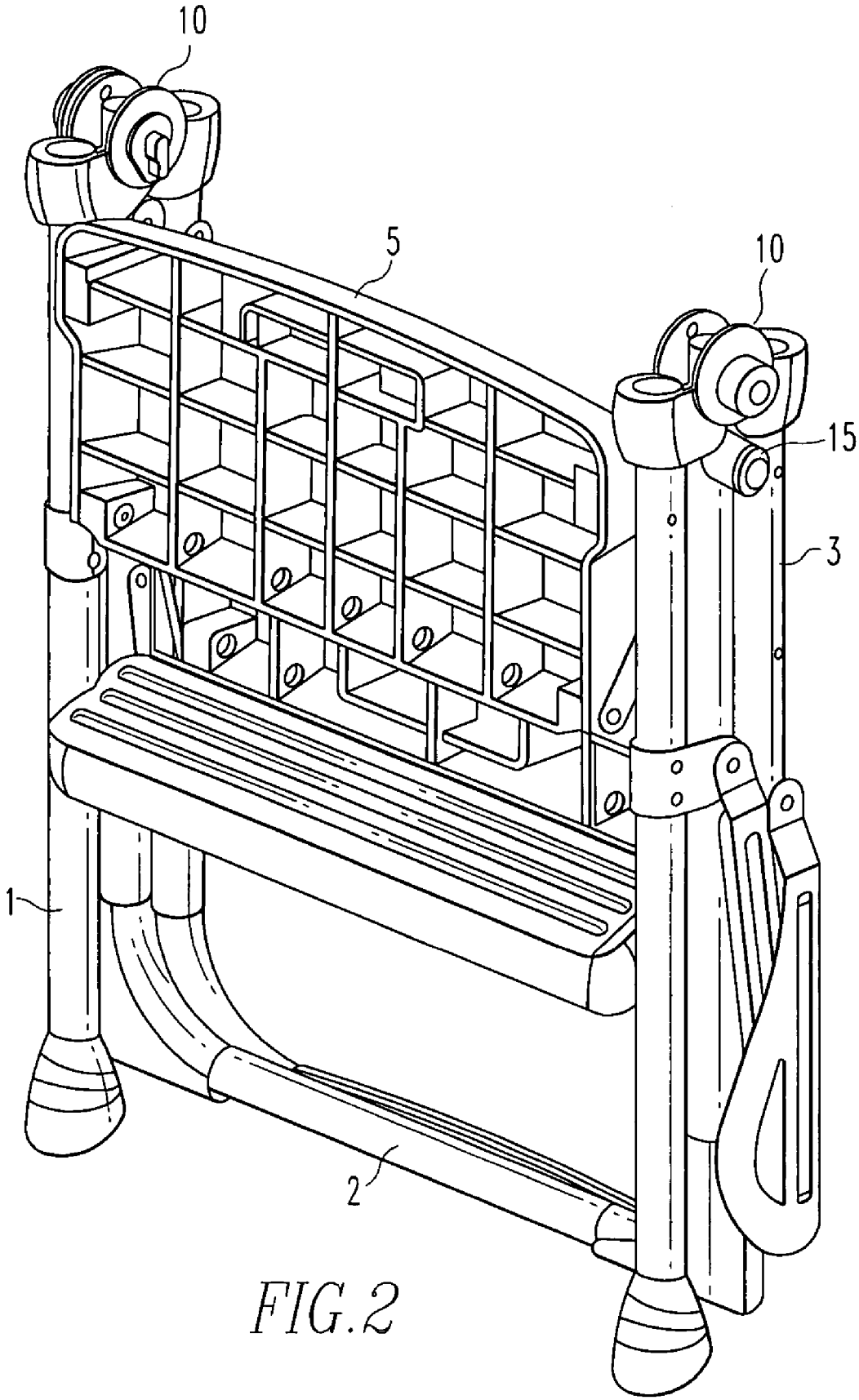
FIG. 2 is a perspective view of the step stool in a folded state.

The folding step stool 100, hereafter called the stool, is shown unfolded and folded in FIGS. 1 and 2, respectively.

The main virtue of this design is in its ability to fold into a very compact size. When unfolded for use, the stool is 39.5 inches tall, 20.75 inches wide and 21 inches long from front to rear. When folded, the stool is only 23.5 inches tall, 20.75 inches wide, and 5.5 inches long from front to rear. In comparison, a conventional 3 step stepstool with the same unfolded dimensions will actually end up being slightly taller when folded than unfolded. Because of its compact folded size, this new stool can easily be stored in the cabinet under the typical kitchen sink or in a small closet.

Stool Construction

Figure 3:
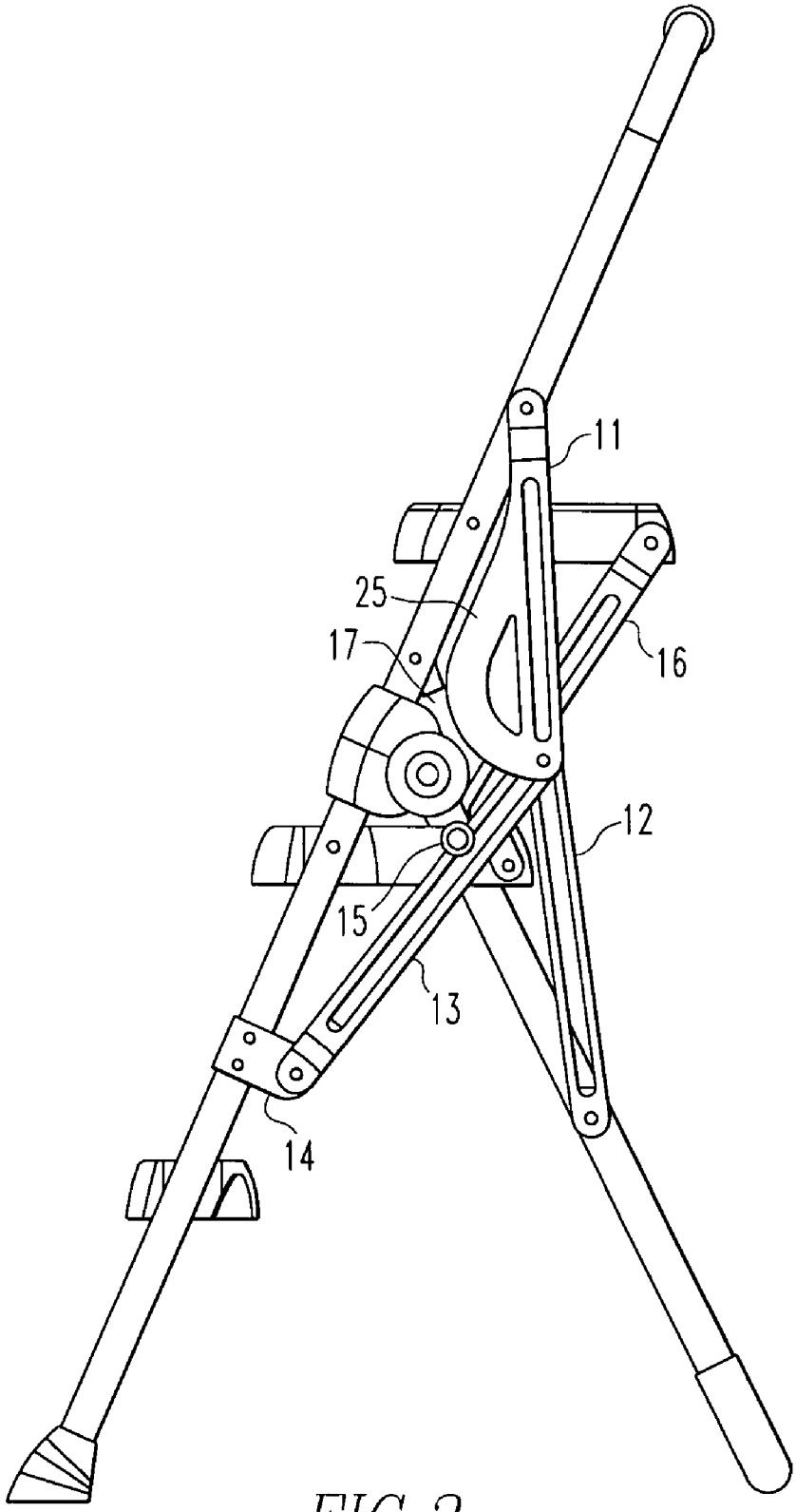
FIG. 3 is a side view of the step stool.

As seen in FIGS. 1, 2, and 3, the stool is made up of a front rail 1, rear rail 2, and top rail 3. The rear rail 2 and top rail 3 are each made from a single piece of steel tubing bent into a "U" shape. The front rail 1 is made from three pieces of steel tubing welded together in roughly the shape of an "H". The cross piece of the "H" is covered by the bottom step 4. The bottom step 4 is rigidly attached to the front rail 1. The middle step 5 and top step 6 are attached at their front ends to the front and top rails, respectively, and are able to pivot relative to the rails. Front feet 7 and rear feet 8 are attached to the front and rear rails. A hand grip 9 is located at the top of the top rail. The steps and rear feet are a molded plastic such as polypropylene while the front feet and handgrip are molded urethane with a durometer of about Shore A 70.

The front, rear and top rails are joined at hinges 10. These hinges 10 allow the stool to transform between the folded and unfolded positions in FIGS. 1 and 2. Details of the hinge construction, their attachment to the rails and of the latches they contain will be presented later.

Top links 11, rear links 12, and front links 13 are located on both sides of the stool outboard of the rails. They are pivotally attached to each other at one end, as shown in FIGS. 1 and 3. The top links 11 and the rear links 12 attach pivotally to the top and rear rails, respectively. The front links 13 attach pivotally to the link brackets 14 which are in turn rigidly attached to the front rail. When the stool is in the unfolded position, as seen in FIGS. 1 and 3, the upper middle area of front links 13 bear against the link braces 15 which in turn are rigidly fastened to the rear rail. These links are made of steel.

Top step links 16 connect the rear of the top step 6 to the rear rail. Middle step links 17 connect the rear of the middle step 5 to the top rail 3. These attachments are all able to pivot. These links are also made of steel.

With the exception of the screws used to attach the rear feet, all the fasteners in this stool are semi-tubular rivets. No fasteners are shown.

Rail Folding Action

FIGS. 4-7 show the stool with the steps and the step links hidden in order to illustrate more clearly the operation of the top, rear and front links as the stool is folded.

Simply speaking, the lengths and attachment points of the top, rear and front links (11, 12, 13) have been calculated so that the front, rear and top rails (1, 2, 3) are parallel when the stool is fully folded and so that the rails move smoothly to their proper positions when the stool is unfolded for use. By design the three pivots 18, 19, and 20 in FIG. 4 have gone 5 degrees past being in line when front links 13 contact the link braces 15. At the same time, the surfaces 21 on the hinges have just come into contact with each other.

As will be explained in more detail later, when the stool is in the unfolded position, a load applied to the steps tends to make the stool stay in the unfolded position.

Step Folding Action

Figure 8:
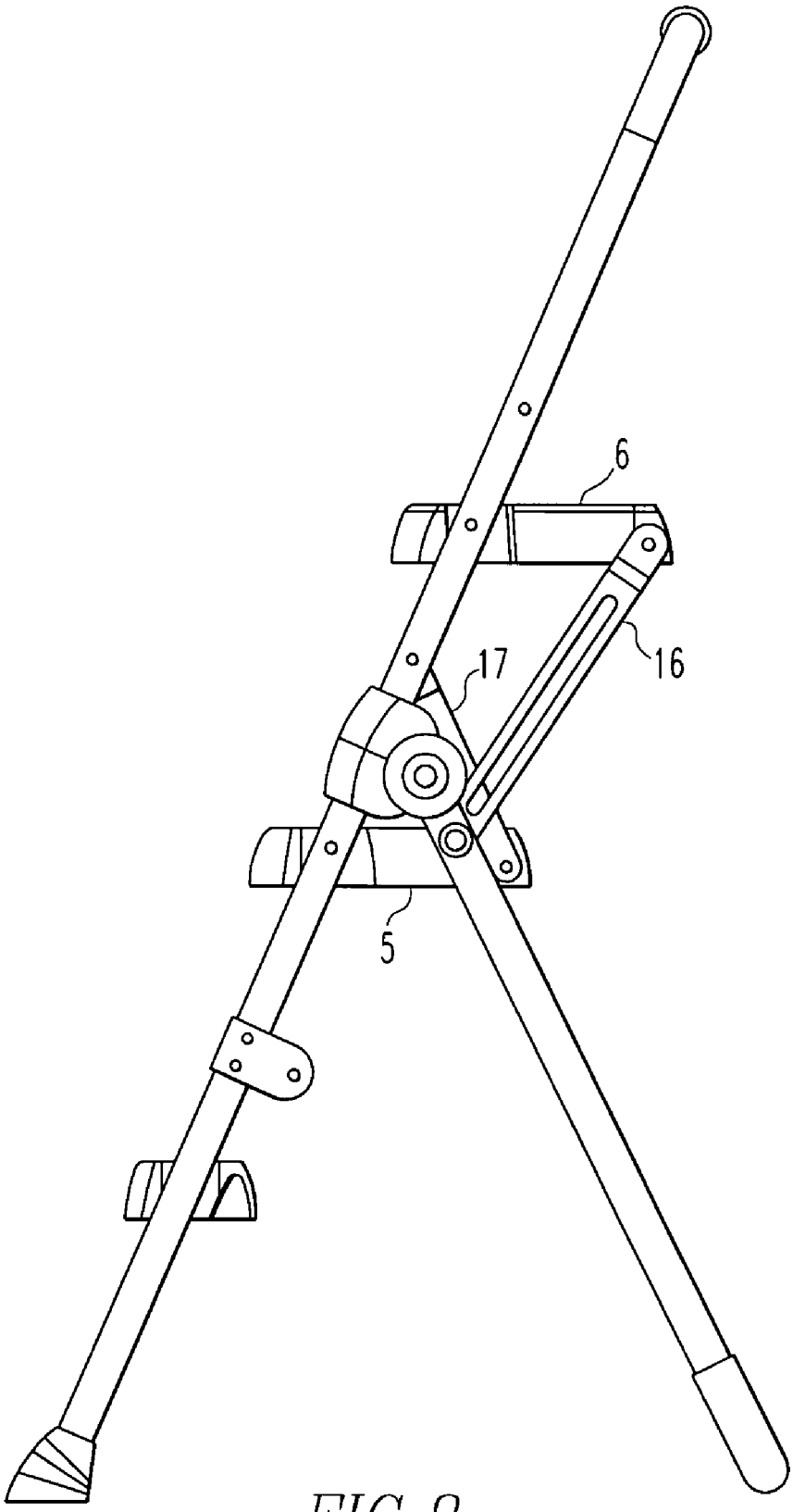
FIG. 8 is a side view of the step stool with certain elements of the support mechanism removed.
Figure 9:
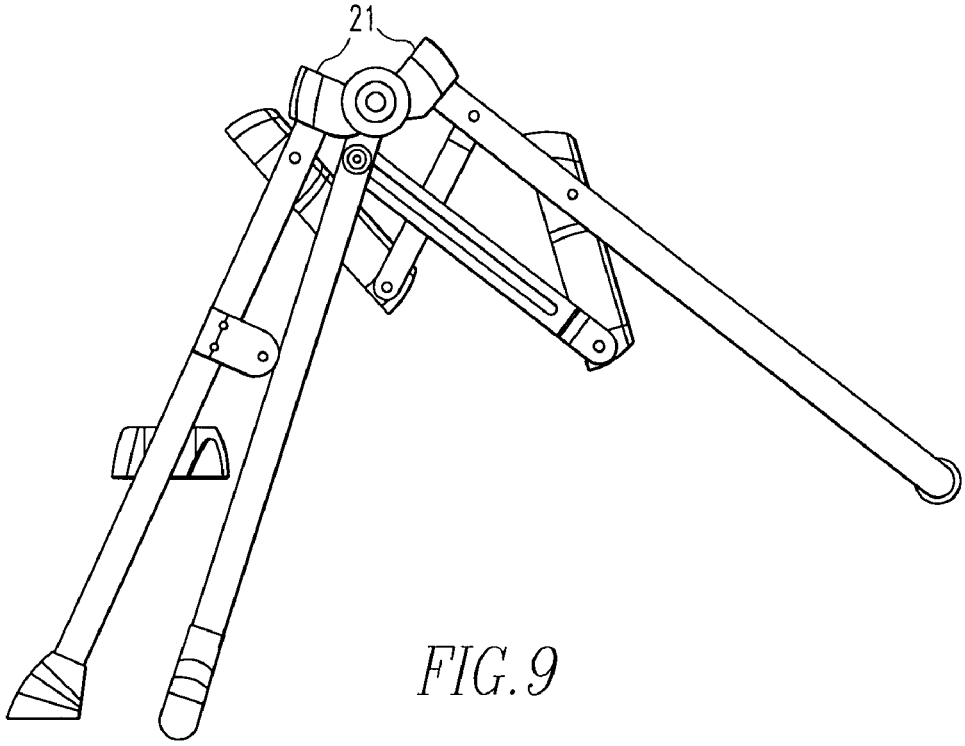
FIG. 9 is a side view of the step stool in an intermediate state between the folded state and unfolded state, with certain elements of the support mechanism removed.
Figure 10:
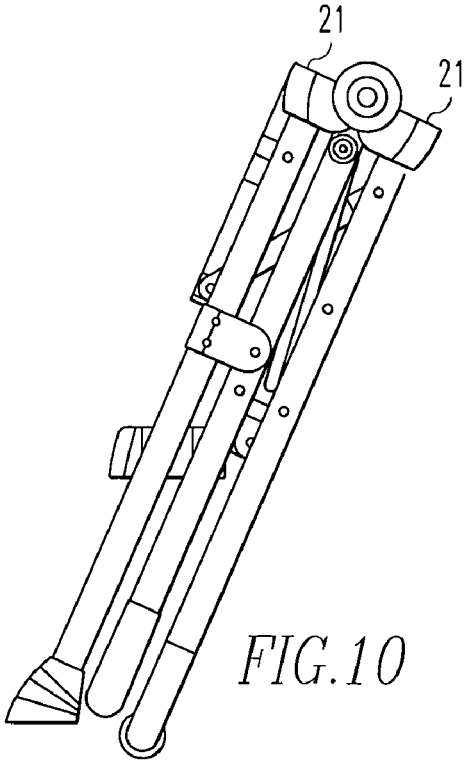
FIG. 10 is a side view of the step stool in a folded state, with elements of the support mechanism missing.

In FIGS. 8, 9, and 10 the linkages outboard of the rails have been hidden so as to show the folding action of the steps more clearly.

The lengths and attachment points of the top step links 16 and the middle step links 17 have been calculated so that the middle and top steps (5, 6) are parallel to the surface on which the stool is resting when the stool is in the unfolded position and are parallel to the front, rear and top rails when the stool is in the folded position.

Operation

To Fold

Beginning with the stool in the unfolded position and the user standing in front of the stool and facing it (the front side of the stool is the side the user would climb), the user would lean the stool forward (towards himself) by pulling on the middle step until the stool is standing only on its front feet. Then while holding the middle step stationary, the user pushes the top step rearward (away from himself). This will cause the rails to pivot at the hinges and the stool to transform to the folded position.

To Unfold

The user stands before the front side of the stool and grasps the front (uppermost) edge of the middle step and the rear (lowermost) edge of the top step. By pulling up on the top step and holding the middle step stationary, the stool will unfold until the front links 13 have contacted the link braces 15. At this point, the stool can be allowed to rest on its four feet and be used.

Additional Features

Figure 11:
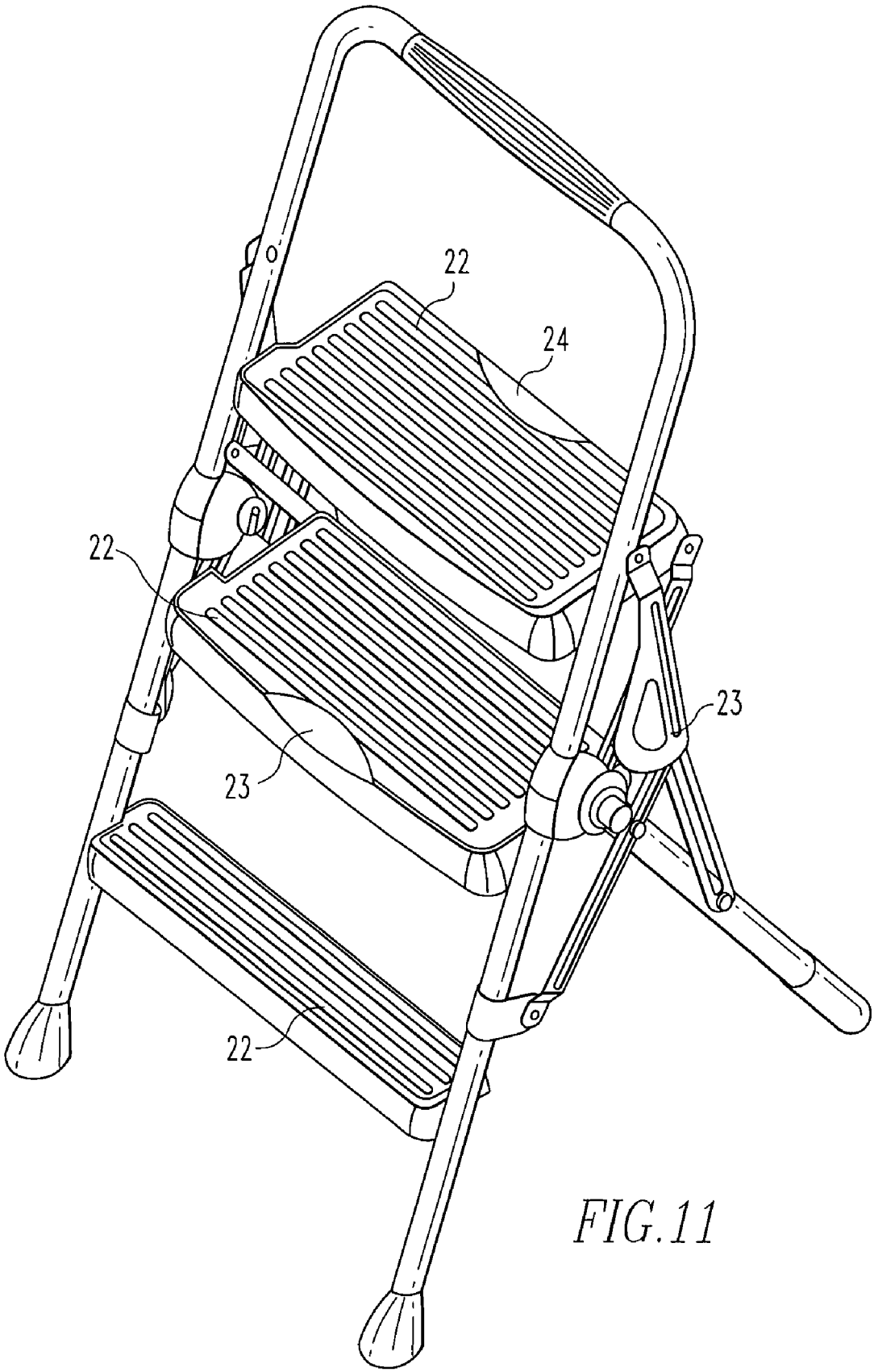
FIG. 11 is an overhead perspective view of the step stool in an unfolded state.

FIG. 11 shows the tread pattern 22 molded into the bottom, middle, and top steps in order to increase traction. Hand grip areas 23 and 24 are molded into the middle and top steps to guide the user to grasp the stool in the best location for folding and unfolding. In addition, the hand grip area 23 on the middle step can be used for carrying the stool when in its folded position.

FIG. 3 shows a semi-circular extension 25 of the top links 11. The primary purpose of this extension is to prevent things, such as the user's fingers, from accidentally being caught between the links as the stool is folded. As can be seen in FIGS. 4, 5, 6, and 7, the camming action of this extension tends to drive objects away from the link pivot 19.

To make the top links 11 lighter, an opening formed by the extension 25 is left in the top links. For aesthetic reasons, these openings are filled with thin molded polypropylene filler pieces 26, seen in FIG. 11.

Locking Hinges

No locking device is essential for the operation of this stool. Once it is fully unfolded, the user's weight tends to keep the stool in the unfolded position. However, it is desirable to have some sort of lock or latch so that: 1. the user can have audible and visible confirmation that the stool is fully unfolded and ready for use, and 2. the stool will not accidentally begin to fold when being lifted and carried in its unfolded position. For these reasons, this stool incorporates latches in its hinges.

FIG. 12 is a close up view of one of the hinges 10. (The other hinge is a mirror image of this one.) The hinge is covered by four molded plastic hinge covers 27 which are for aesthetic appearance. These covers snap together at assembly to envelope the hinge components.

Figure 13:
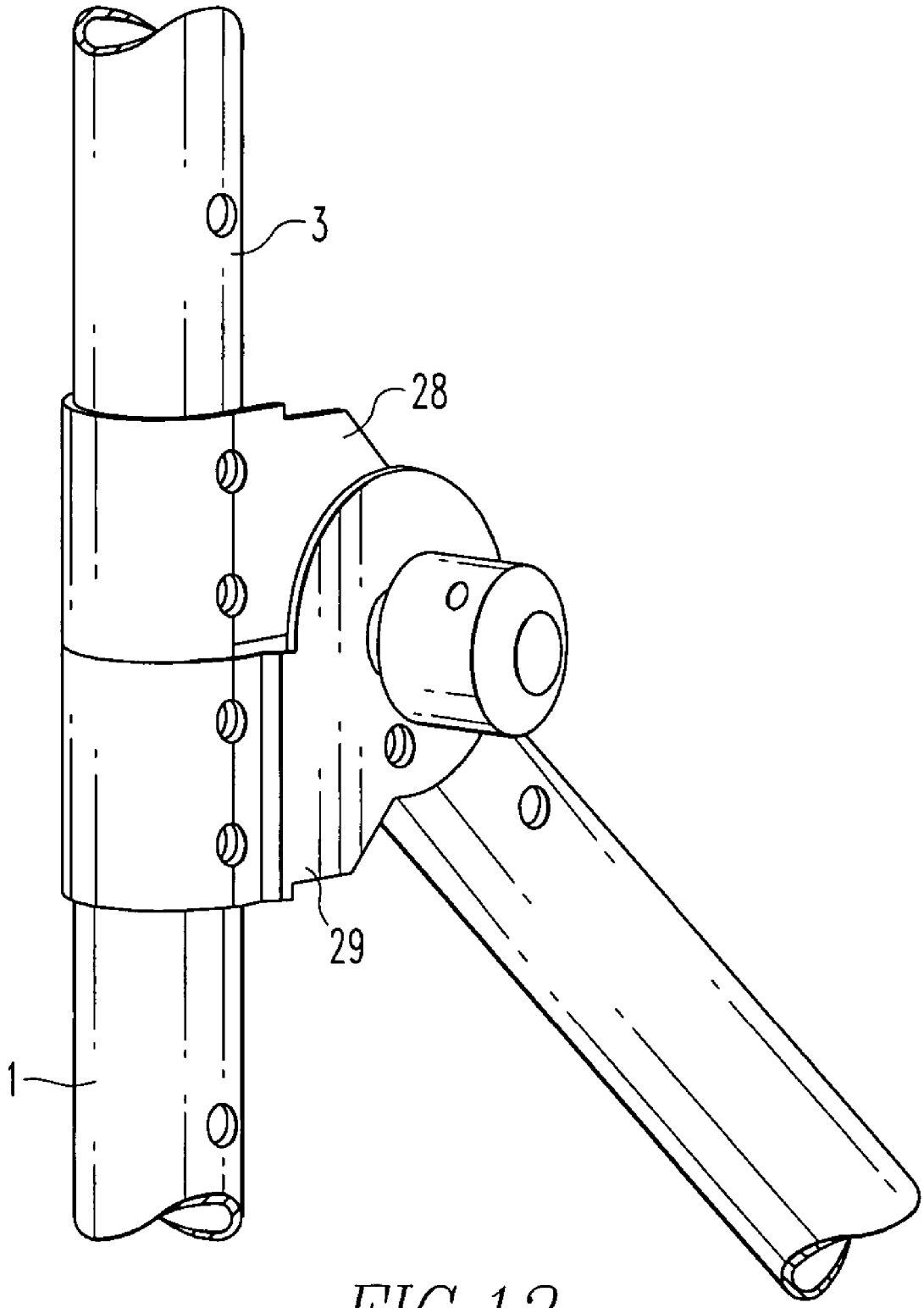
FIG. 13 shows the hinge with the outer cover removed.

FIG. 13 shows the hinge with the hinge covers removed. The hinge 10 consists of an upper hinge portion 28 and a lower hinge portion 29. Both these parts are steel. The front rail 1 is attached to the lower hinge portion, the top rail 3 is attached to the upper hinge portion. FIG. 14 shows the hinge partially folded. The rear rail 2 pivots on the bushing 30 which is effectively the hinge pin of the hinge.

FIG. 15 is an exploded view of the hinge. The rails are not shown.

The steel bushing 30 is inserted through the large holes in the upper and lower hinges 28 and 29. The flat on the bushing, 30A, lines up with the flat in the "D" shaped hole 28A in the upper hinge. Because of this flat, the bushing is constrained to rotate with the upper hinge when the hinge is folded and unfolded. The bushing has a slot 30B cut in one end which opens into the central hole in the bushing.

The bar 31 has a long shank that can slide axially and rotate freely in the center hole of the bushing. A projection on the bar, 31A, is a sliding fit in a hole 29A in the lower hinge. At no time when assembled does this projection 31A move out of the hole 29A. Thus, the bar 31 is constrained to rotate with the lower hinge when the hinge is folded or unfolded. By sliding the bar axially, the projection 31A can be made to engage or disengage from the hole 28B in the upper hinge. The bar has a groove 31B cut on the side.

The knob 32 is attached to the end of the shank of the bar with a through pin, not shown. The spring 33 goes around the shank of the bar and is compressed between the knob 32 and the bushing 30.

The clip 34 is a roughly "D" shaped piece of spring steel wire. When assembled, the straight part of the clip 34A rests in the slot 30B of the bushing, protruding into the central hole of the bushing about 0.040 inch. The curved part of the clip wraps around the bushing. When the bar 31 is assembled into the bushing 30, the round shank of the bar displaces the straight part of the clip radially outward unless the groove 31B is aligned with the slot 30B. The clip 34 serves to retain the bushing 30 in the hinge assembly and also to hold the bar 31 in the unlatched position as will be seen.

Figure 16:
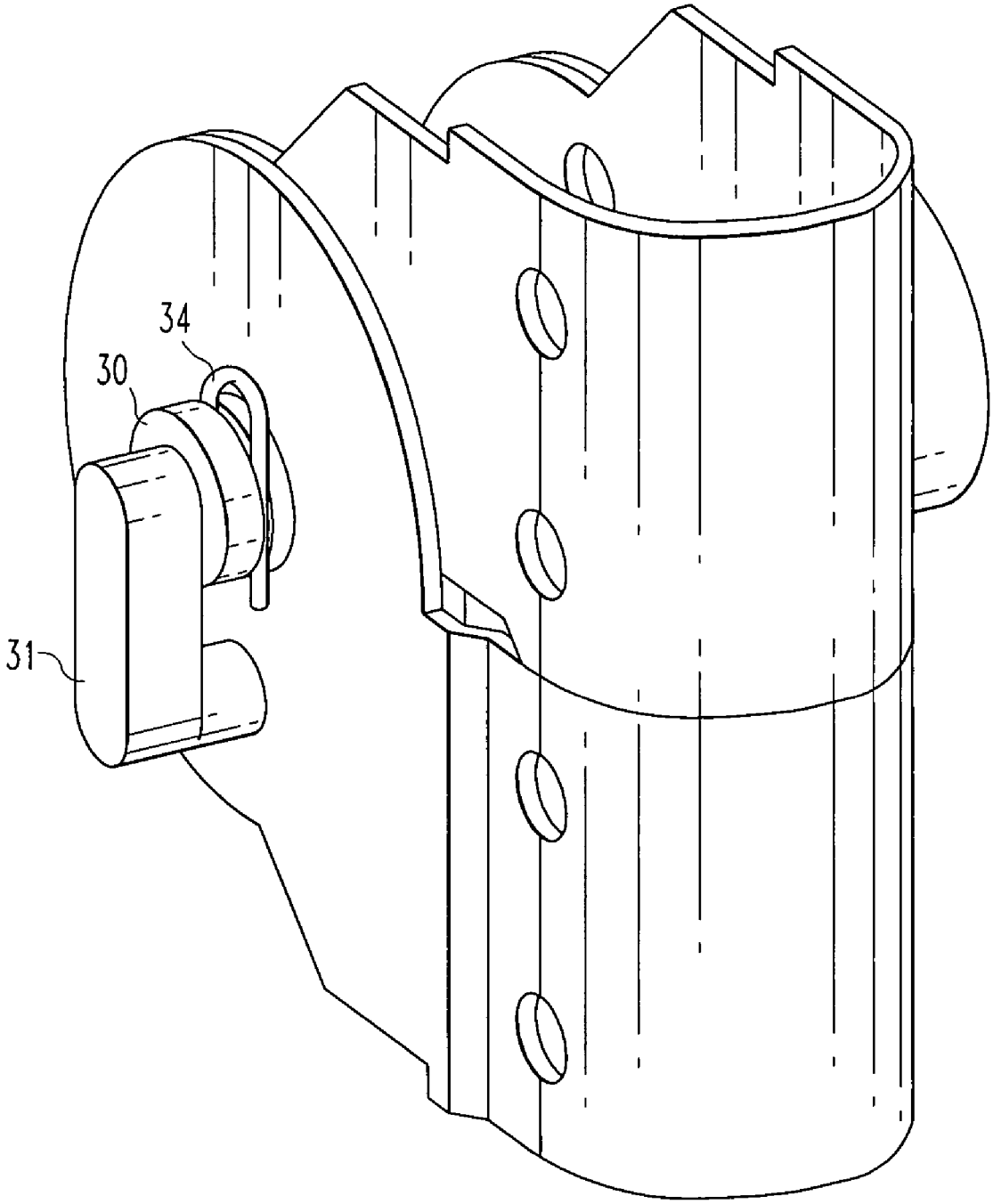
FIG. 16 shows the hinge in a latched position.
Figure 17:
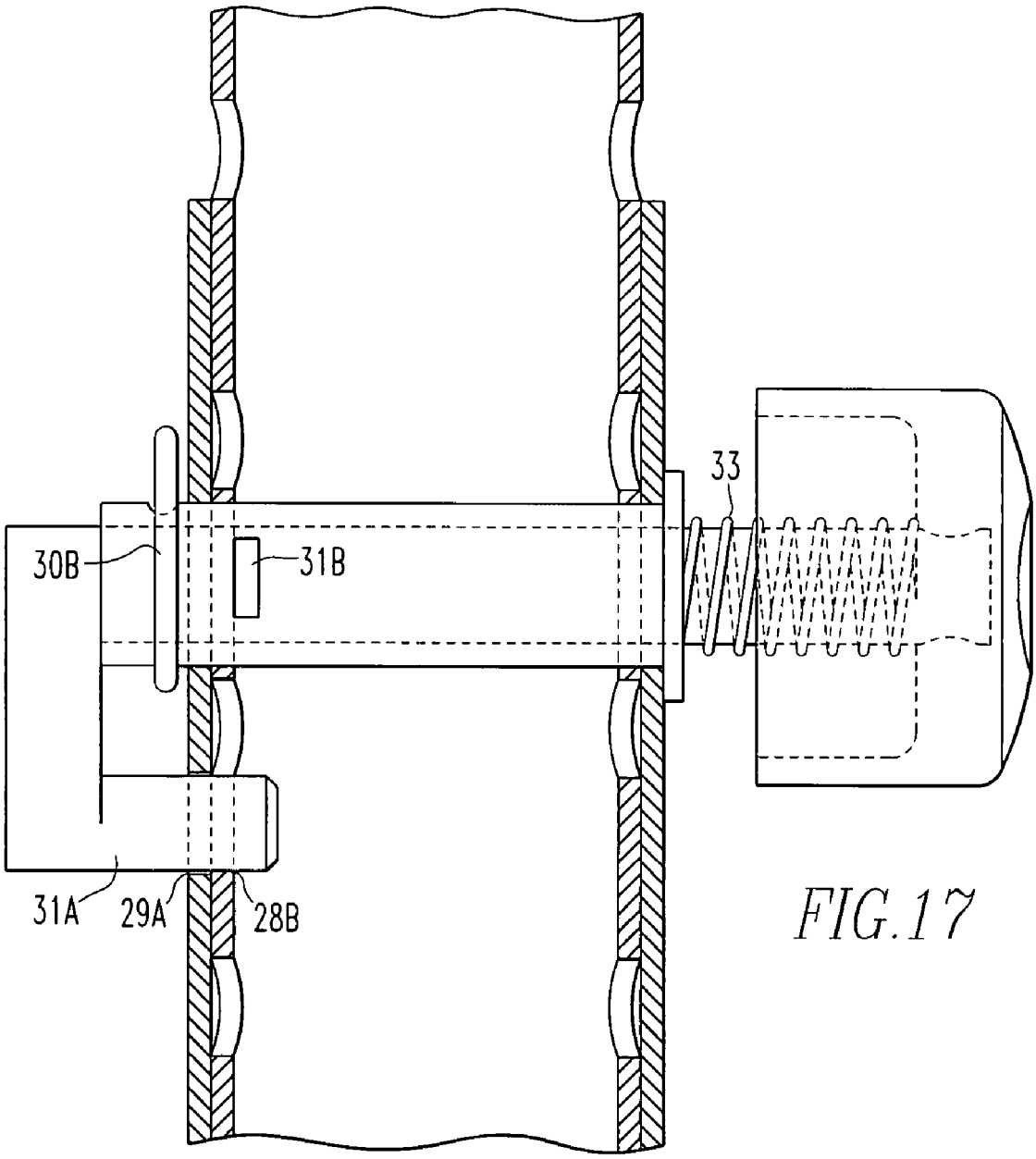
FIG. 17 is a front cross-sectional view of the hinge.

FIG. 16 shows the hinge in the latched position. FIG. 17 is a front view. Notice that 31A is sticking through both 29A and 28B, thus preventing the upper hinge from rotating relative to the lower hinge. The spring 33 exerts force on the bar to the right, tending to keep the bar in the locked position. Notice that the groove 31B is not aligned with the slot 30B.

Figure 18:
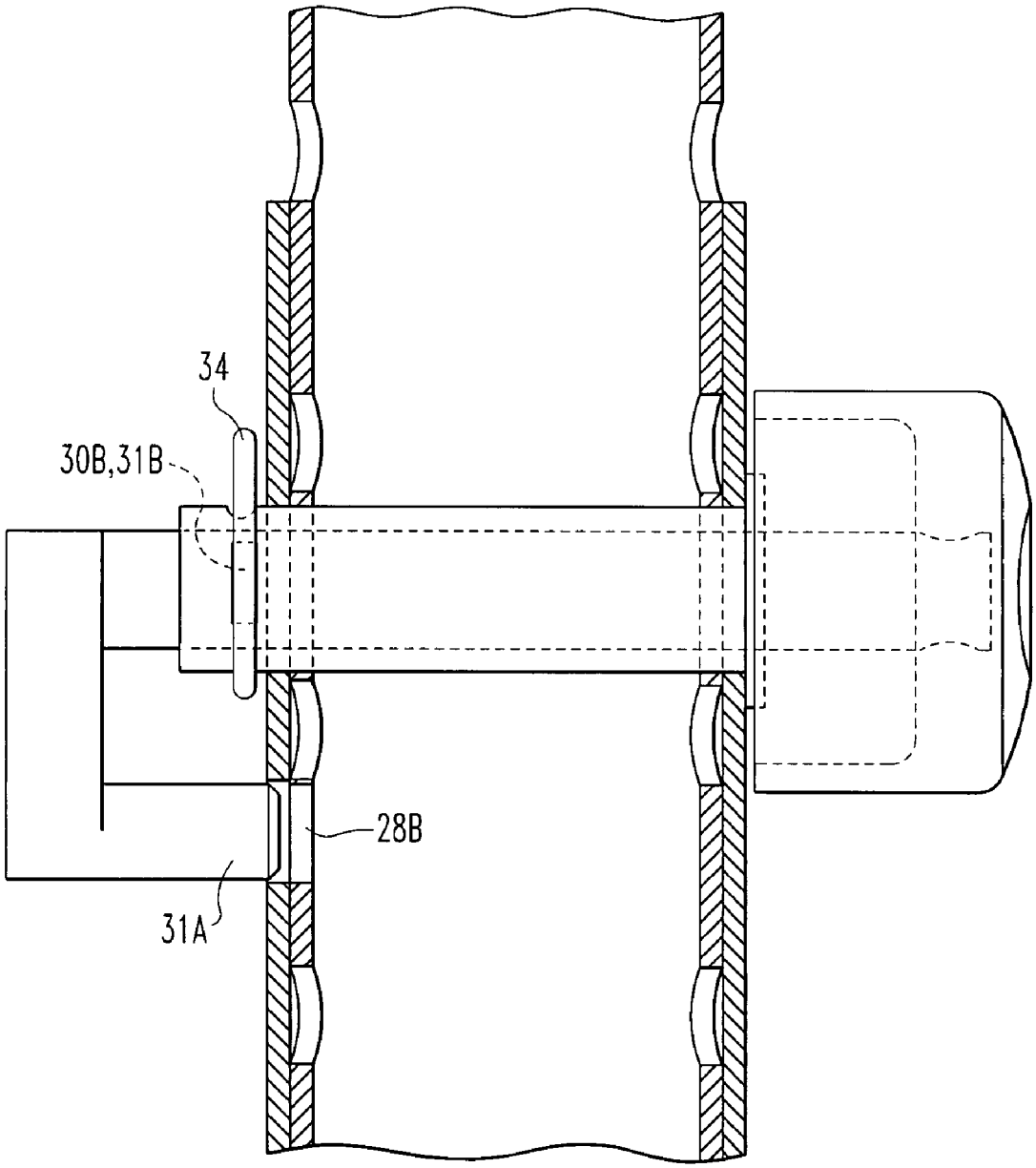
FIG. 18 shows the hinge after the knob has been pushed in to unlock the hinge.

FIG. 18 shows the hinge after the knob has been pushed in to unlock the hinge. The spring is not shown. Notice that the slot and groove, 30B and 31B, are aligned, allowing the straight part of the clip 34A to snap into engagement with the groove 31B. This engagement holds the bar to the left in spite of the force from the spring. Notice that 31A has retracted out of 28B. At this point, the stool may be folded.

Figure 19:
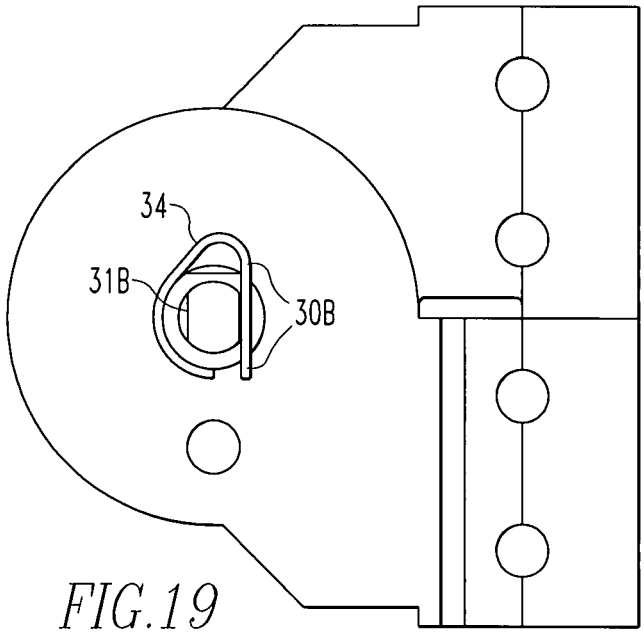
FIG. 19 shows a cross-sectional view of the hinge along a center axis.

FIG. 19 shows a cut through the center of the slot 30B when the bar 31 is as shown in FIG. 18. Slot and groove 30B and 31B are parallel allowing clip 34 to engage both.

Figure 20:
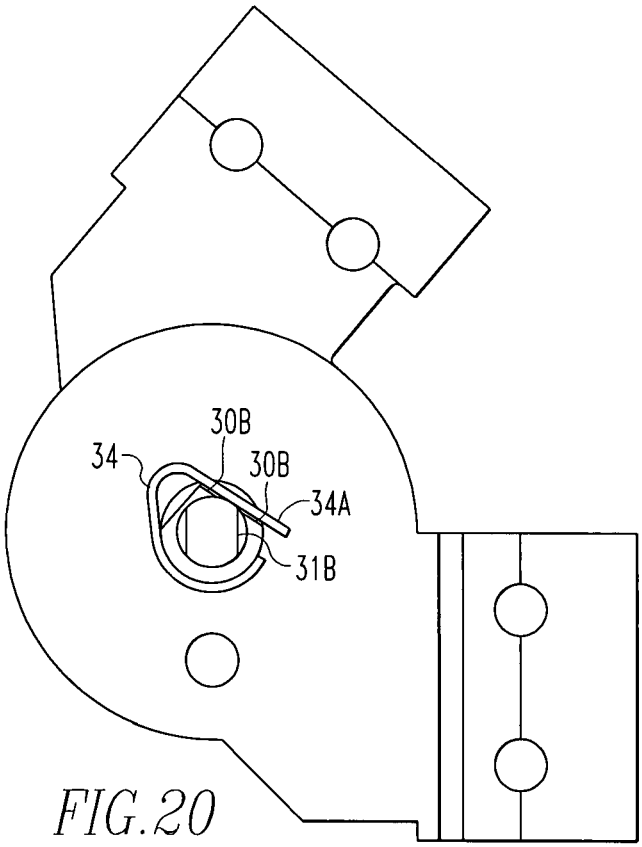
FIG. 20 shows a cross-sectional view of the hinge along its central axis with the upper and lower hinges rotated towards the folded state.

FIG. 20 is the same view as FIG. 19 but after the upper and lower hinges have been rotated toward the folded position some amount. Notice that the slot 30B has rotated out of alignment with the groove 31B. This rotation forces the straight section of the clip 34A to disengage the groove 31B. Thus, the bar 31 is free to slide axially toward the locked position under the influence of the spring 33. The bar will snap completely into the locked position the next time either hole 28B or 28C (FIG. 15) line up with hole 29A. So the hinge can be locked in either the folded or unfolded positions.

On a stool equipped with these locking hinges, the operation to fold or unfold the stool would be as described above but with the addition that prior to folding or unfolding, the user would first push in on both knobs until they are heard and felt to catch, thus unlocking the hinges. Then at some point between folding and unfolding, the bars will be heard to snap outward, ready to lock the hinges. Finally, when the stool completes the folding or unfolding motion, the bars will be heard and seen to snap into the locked position again.

Support of Loads

Figure 4:
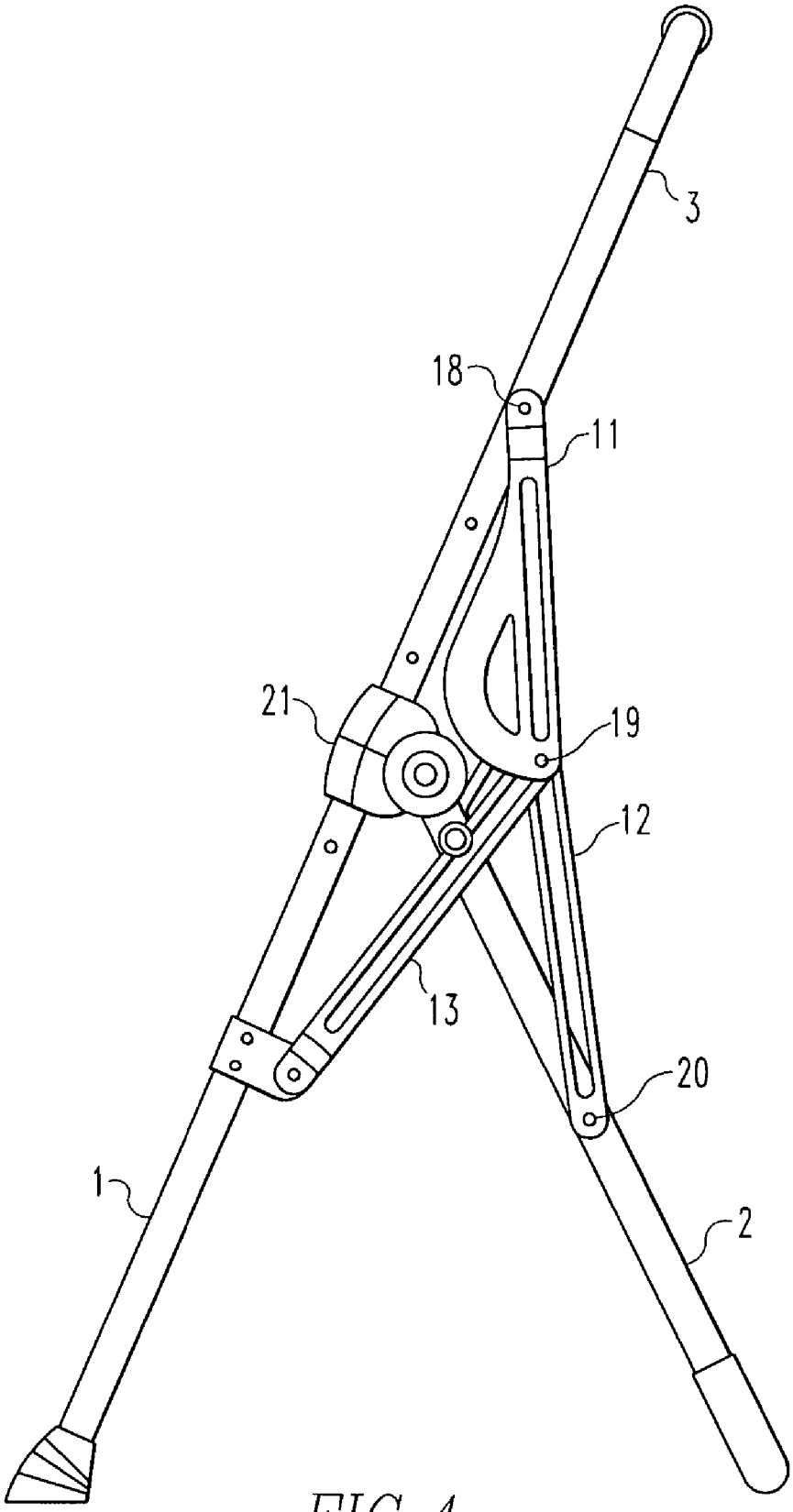
FIG. 4 is a side view of the step stool without the steps.
Figure 5:
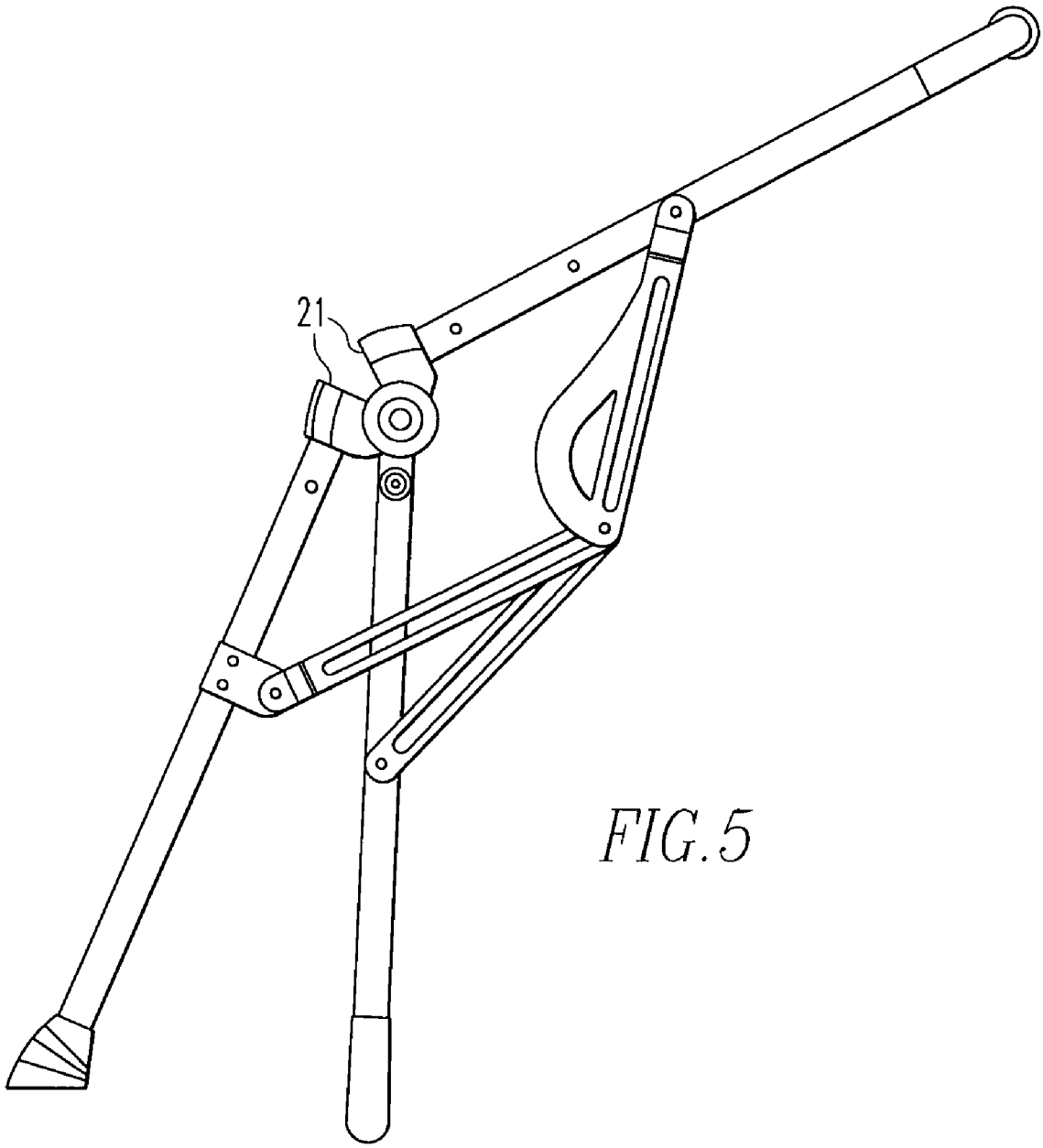
FIG. 5 is a side view of the step stool in an intermediate state between the folded state and the unfolded state, without steps.
Figure 6:
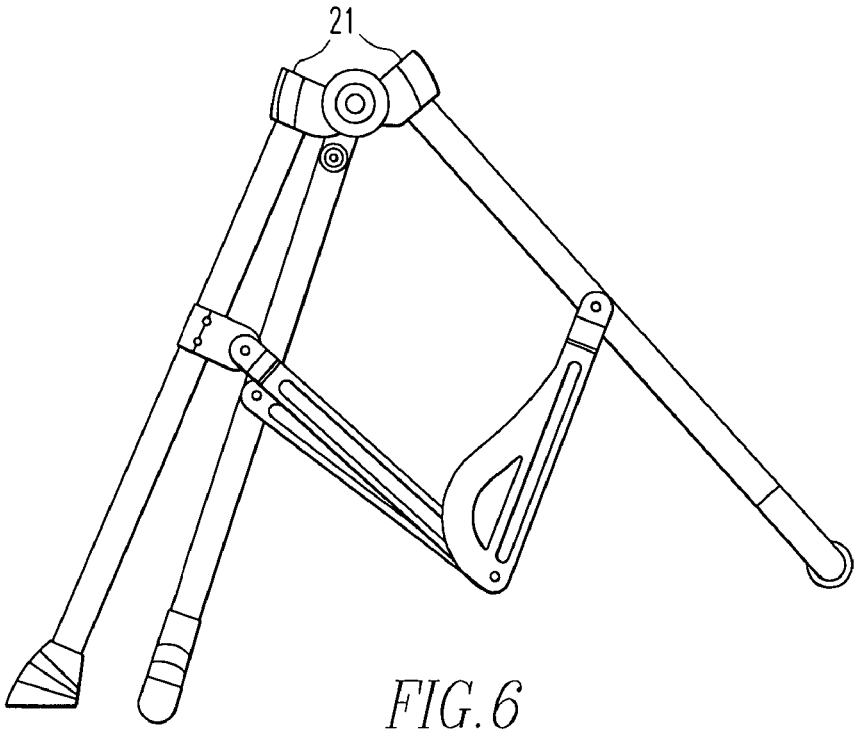
FIG. 6 is a side view of the step stool as it approaches the folded state.
Figure 7:
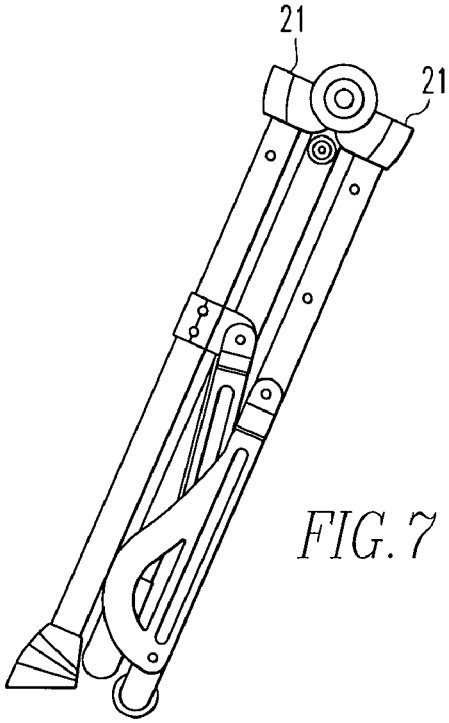
FIG. 7 is a side view of the step stool in a folded state, without steps.

The following is a brief description of how loads are supported through the rails and linkages of the stool. Refer to FIGS. 3, 4 and 14.

When the stool is moved to its unfolded position, the rear rail 2 will rotate about the hinges relative to the front rail 1 until front links 13 come into contact with the link braces 15. At this point the front and rear rails have formed a solid base for supporting loads. At the same time, the top links 11 are solidly supporting the top rail 3 in its unfolded position.

When a person stands on the bottom step 4, the load is applied to the front rail. To support this load, opposing forces are exerted by the floor upward through the front and rear feet 7 and 8. Forces through the front feet are carried directly up through compression of the front rail to the bottom step. Forces through the rear feet are carried up through the rear rail, then divide. Part of the force is carried through the bushing 30 in the hinge to put the upper part of the front rail in tension. The rest of the force puts link 12 in compression and link 13 in tension. The tension force in link 13 is carried through the link bracket to the front rail. In addition a lateral component of force is carried from the link 13 to the link brace 15, to the hinge and into the front rail.

When a person stands on the middle step 5 the load is applied to both the front rail and, through tension in middle step links 17, to the top rail 3. The front rail load is supported as when the load was on the bottom step. Forces to oppose the top rail force are carried through the bushing of the hinge and also through compression in link 11. Link 12 in turn is also in compression, putting the rear rail in compression.

When a person stands on the top step 6 the load is applied directly to the top rail and also to the rear rail through compression forces in link 16. Some of the load is carried through the top rail, through the hinge bushing and so forth as before. Link 16 applies a force to the rear rail which is supported by the hinge bushing and by the floor.

So it can be seen that the system of linkages serve not only to synchronize the folding and unfolding of the stool components but also to carry the loads the stool supports when in use.

Some Dimensional Details

As presently designed, the stool has front, rear, and top rails made from welded steel tubing having an outside diameter of 1 inch and a wall thickness of 0.049 inches.

All the links are made of steel, 0.093 inches thick.

The overall weight of the stool should be about 15 pounds.

Figure 21:
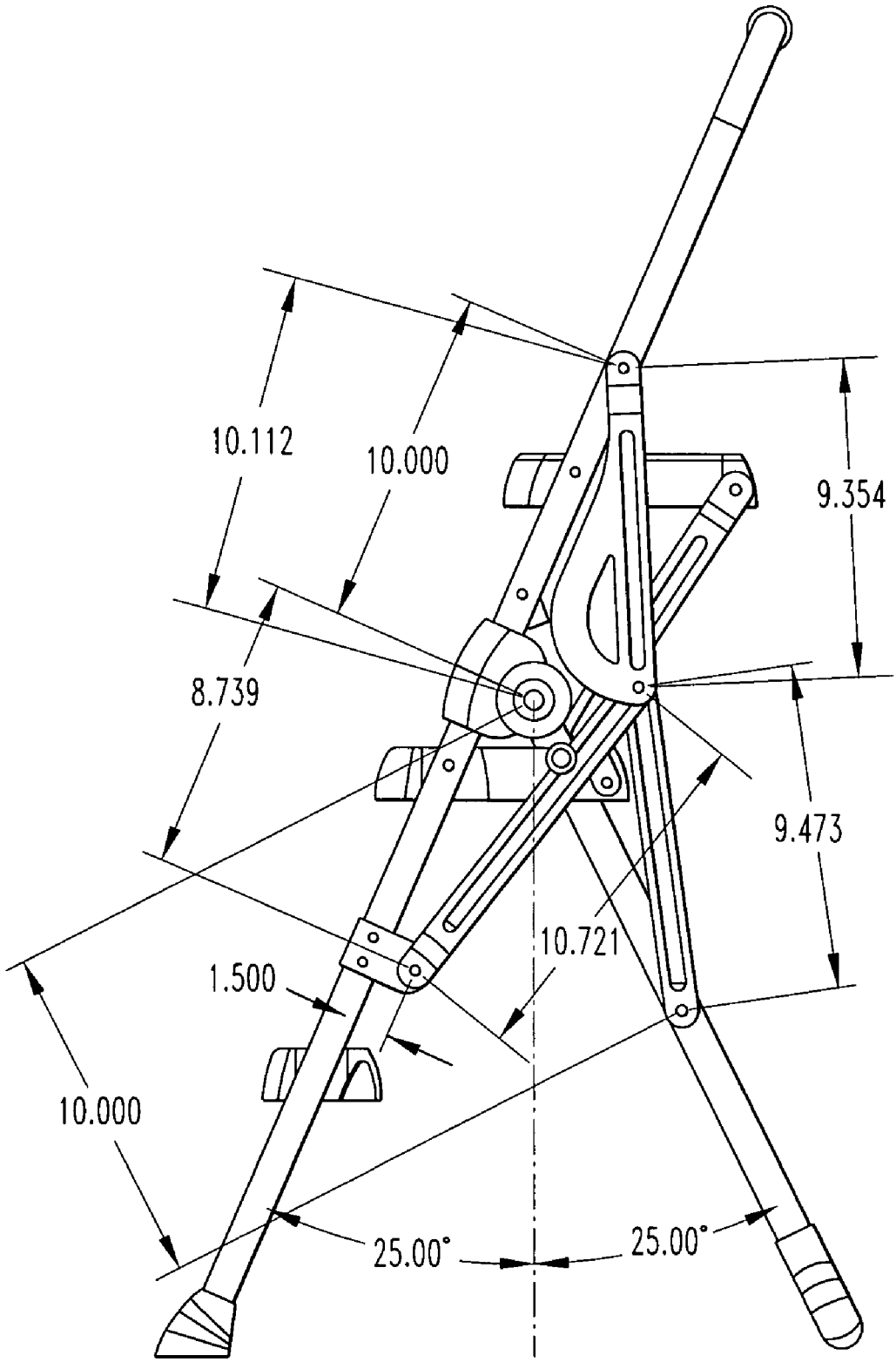
FIG. 21 is a side view of the step stool.

FIG. 21 is a side view of the stool showing the dimensions of the links and pivot points which will produce one embodiment of this invention.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A hinge for a folding step stool comprising:

a top rail;

an upper hinge having a c shape that surrounds the top rail;

a front rail;

a rear rail;

a lower hinge having a c shape that surrounds the front rail, the upper hinge comprises two upper hinge plates that surround the rear rail and the lower hinge comprises two lower hinge plates that surround the upper hinge plates and the rear rail;

a bushing that extends through the upper and lower hinges and rear rail and holds the upper and lower hinges and rear rail together and about which the upper and lower hinges and rear rail rotate relative to each other and the top rail, front rail and rear rail are held by the upper hinge and lower hinge essentially parallel in a folded state and the top rail is held in alignment with the front rail by the upper hinge and the rear rail is held in an acute angle with the front rail by the lower hinge in an unfolded state; and a bar that has a shank and a projection, and the bushing has a center hole in which the shank is disposed and rotates freely, and the projection fits into the lower hinge which constrains the bar to move with the lower hinge in the folded or unfolded state, and the projection fits into the upper hinge and either engages or disengages the upper hinge when the bar is slid axially in the bushing.

2. A hinge as described in claim 1 wherein the top, front and rear rails each have a circular cross section.

3. A hinge as described in claim 2 wherein the top, front and rear rails each are hollow.

4. A hinge as described in claim 3 wherein the bar has a common element from which the shank and the projection extend in parallel in a same direction from a same side of the hinge, and a knob attached to the shank of the bar, with the upper hinge and lower hinge disposed between the knob and the common element of the bar.

5. A hinge as described in claim 4 wherein the bushing has a flat and the upper hinge has a D shaped hole which aligns with the flat which constrains the bushing to rotate with the upper hinge.

6. A hinge as described in claim 5 including a spring which is compressed between the knob and the bushing.

7. A hinge as described in claim 6 wherein the bushing includes a bushing slot and the hinge includes a clip which wraps about the bushing and rests in the bushing slot which serves to retain the bushing in place and to hold the bar in an unlatched position.

8. A hinge as described in claim 7 wherein the spring exerts a force on the bar to keep the bar in a locked position.

* * * * *